US012612207B2

(12) United States Patent
Dominguez, III et al.

(10) Patent No.: US 12,612,207 B2
(45) Date of Patent: Apr. 28, 2026

(54) BAG FORMER WASHING SYSTEMS AND METHODS

(71) Applicant: Formers International, Inc., Pasadena, TX (US)

(72) Inventors: John Dominguez, III, Pasadena, TX (US); Jose A. Villarreal, Gun Barrel City, TX (US); James Rodney Leija, League City, TX (US); Shawn Bradley Byars, League City, TX (US)

(73) Assignee: Formers International, Inc., Pasadena, TX (US)

( * ) Notice: Subject to any disclaimer, the term of this patent is extended or adjusted under 35 U.S.C. 154(b) by 0 days.

(21) Appl. No.: 18/744,487

(22) Filed: Jun. 14, 2024

(65) Prior Publication Data

US 2025/0382086 A1 Dec. 18, 2025

(51) Int. Cl.
*B65B 55/24* (2006.01)
*B65B 9/22* (2006.01)

(52) U.S. Cl.
CPC ..... *B65B 55/24* (2013.01); *B65B 9/22* (2013.01)

(58) Field of Classification Search
None
See application file for complete search history.

(56) References Cited

U.S. PATENT DOCUMENTS 2,785,694 A 3/1957 Stewart
4,167,950 A * 9/1979 Schaefer ..... B60S 3/008 134/52
4,532,754 A 8/1985 Hokanson
4,711,068 A 12/1987 Dominguez
4,766,716 A 8/1988 Dominguez
6,589,147 B2 7/2003 Dominguez, Jr. et al.
6,735,928 B2 5/2004 Kondo et al.
7,523,597 B2 4/2009 Dominguez, Jr. et al.
9,463,886 B2 10/2016 Dominguez, Jr. et al.
9,907,450 B2 3/2018 Jadhav et al.
10,392,142 B2 8/2019 Dominguez, Jr. et al.
(Continued)

FOREIGN PATENT DOCUMENTS

WO 2017/192050 A1 11/2017
WO 2018/147732 A1 8/2018

OTHER PUBLICATIONS

International Search Report and Written Opinion for PCT/US2025/033560 Dated Dec. 15, 2025, 18 pages.
(Continued)

*Primary Examiner* — Eric W Golightly
(74) *Attorney, Agent, or Firm* — Patterson + Sheridan, LLP

(57) ABSTRACT

A method for washing a bag former using a bag former washing system includes mounting a bag former onto a cart, positioning the cart with the bag former in a washing chamber, washing the bag former with a cleaning product sprayed from a washing chamber nozzle, and removing the cart with the bag former from the washing chamber. The bag former washing system includes a prewashing station, the washing chamber with the washing chamber nozzle, a cleaning supply system, a drying station, a track that extends from the prewashing station to the drying station, and the cart. The cart is movable along the track between the prewashing station, the washing chamber, and the drying station.

20 Claims, 11 Drawing Sheets

(56) References Cited

U.S. PATENT DOCUMENTS

| | | | | |
|---|---|---|---|---|
| 2012/0121462 | A1* | 5/2012 | Bacik | A61L 2/208 588/1 |
| 2018/0318887 | A1* | 11/2018 | Samuelsson | A61L 2/04 |
| 2024/0082767 | A1 | 3/2024 | Dominguez, III et al. | |

OTHER PUBLICATIONS

Invitation To Pay Additional Fees for PCT/US2025/033560 Dated Oct. 23, 2025, 14 pages.

* cited by examiner

BAG FORMER WASHING SYSTEMS AND METHODS

BACKGROUND

Field

The present disclosure relates generally to bag formers, and in a particular, a bag former washing system and method.

Description of the Related Art

Bag formers are used to package one or more products, such as food, e.g. potato chips, into bags. The bag former helps form the shape of the bag and guides the product into the bag, which is ultimately sealed to form a packaged product. The bag former needs to be cleaned after repeated use due to buildup of product residue (such as seasoning from potato chips) within the bag former. However, due to the unique size and shape of the bag former, it is difficult to wash the bag former effectively. Therefore, there is a need for new and/or improved systems and methods for washing bag formers.

SUMMARY

In one embodiment, a method for washing a bag former comprises mounting a bag former onto a cart; positioning the cart with the bag former in a washing chamber, the washing chamber comprising a washing chamber nozzle; washing the bag former with a cleaning product sprayed from the washing chamber nozzle, wherein the cleaning fluid is sprayed into an interior region of the bag former; and removing the cart with the bag former from the washing chamber.

In one embodiment, a bag former washing system comprises a prewashing station; a washing chamber comprising a nozzle configured to spray a cleaning product into the washing chamber; a cleaning supply system configured to supply the cleaning product to the nozzle of the washing chamber; a drying station; a track that extends from the prewashing station to the drying station; and a cart movable along the track between the prewashing station, the washing chamber, and the drying station.

In one embodiment, a bag former washing nozzle comprises a body; an inlet disposed at a first end of the body comprising a horizontal central axis; a conical outlet with an increasing diameter disposed at a second end of the body comprising a central axis that is at an angle relative to the central axis of the inlet, wherein a flow path comprising varying diameters connects the inlet and the outlet; a conical flow splitter with an increasing diameter disposed in the outlet and disposed along the central axis of the outlet; and at least one recess cut in a surface of the conical outlet.

BRIEF DESCRIPTION OF THE DRAWINGS

So that the manner in which the above-recited features of the disclosure can be understood in detail, a more particular description of the disclosure, briefly summaries above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The disclosure contemplates that terms such as "couples," "coupling," "couple," and "coupled" may include but are not limited to welding, interference fitting, magnetic coupling, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 1B:
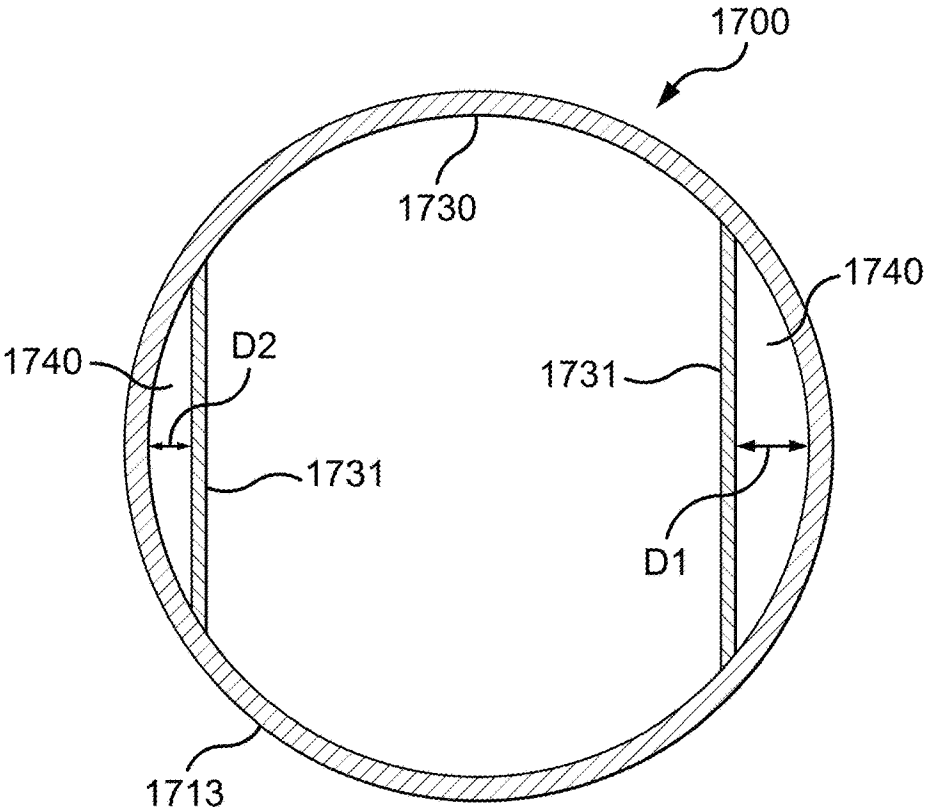
FIG. 1B illustrates a bottom sectional view of the bag former of FIG. 1A, according to one or more embodiments.
Figure 1A:
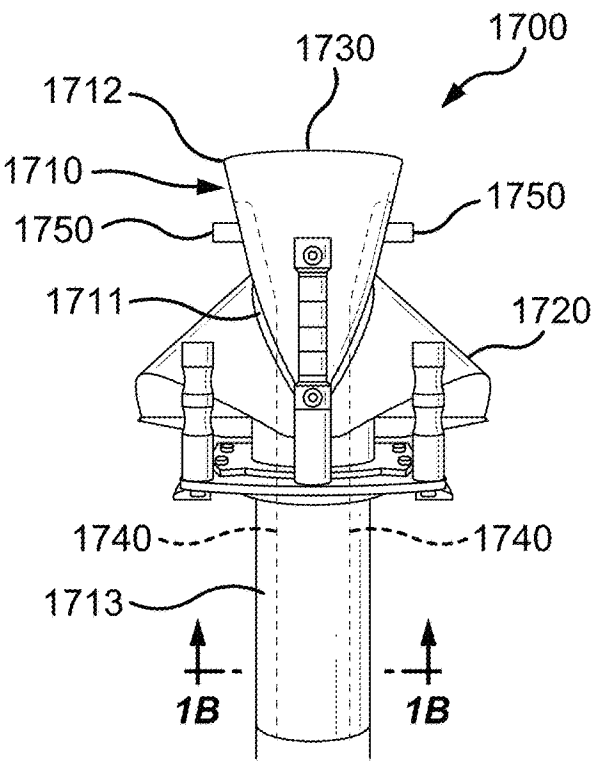
FIG. 1A illustrates a side view of a bag former, according to one or more embodiments.

FIGS. 1A-1B illustrate a bag former 1700, according to one embodiment.

FIG. 1A illustrates a side view of the bag former 1700. The bag former 1700 includes at least a fill tube 1710 and a former guard 1720. The former guard 1720 is a semi-conical piece of sheet metal disposed at least partially around the fill tube 1710 with a gap 1711 between the former guard 1720 and the fill tube 1710. The fill tube 1710 is hollow, extends through the former guard 1720, and has an upper tapered section 1712 and a lower straight section 1713.

FIG. 1B illustrates a bottom sectional view of the bag former 1700. The bag former contains one or more gas channels 1740 disposed on the interior of the fill tube 1710. The gas channels 1740 are sectioned off portions of the interior of the fill tube 1710 and may run the length of the fill tube 1710 through the upper tapered section 1712 and the lower straight section 1713. The gas channels 1740 may be formed by one or more plates 1731 that are coupled (e.g. welded) to an interior 1730 of the fill tube 1710. The gas channels 1740 are used to direct gas supplied through one or more gas channel fittings 1750 (disposed on the exterior of the bag former 1700) out of the bottom of the fill tube 1710. The upper ends of the plates 1731 are sealed to the interior 1730 of the fill tube 1710 where the gas channel fittings 1750 direct gas into the gas channels 1740. The lower ends of the plates 1731 are open ended to allow the gas to flow out of the lower ends of the gas channels 1740 at the bottom of the fill tube 1710. In one embodiment, an inner tube may be coupled (e.g. welded) to the interior 1730 of the fill tube 1710, which forms a gap between the inner tube and the fill tube 1710 to create an annular gas channel through which gas may flow. The gas flowing through the gas channels 1740 helps the flow of product out through the bottom of the fill tube 1710.

The size of the gas channels 1740 and the fittings 1750 may be based on the size of the bag former 1700, the product flowing through the bag former 1700, and/or gas flow needs. The gas channel fittings 1750 may be sized to receive a fluid line, such as a gas line, with diameters including, but not limited to, about 0.125 inches to about 1.0 inches. With bag formers 1700 having more than one gas channel 1740, the gas channels 1740 may be different sizes, for example, having a channel width of D1 that is greater than a width of D2 as illustrated. Similarly, with bag formers 1700 having more than one gas channel fitting 1750, the gas channel fittings may be different sizes, for example having different inner and/or outer diameters. Although two gas channel fittings 1750 and gas channels 1740 are illustrated in FIG. 1A, the bag former 1700 may include one, two, three, four, or more gas channel fittings 1750 and gas channels 1740. In one embodiment, the bag former 1700 may include only one gas channel 1740 located at any circumferential position along the interior of the fill tube 1710. In one embodiment, the bag former 1700 may include two or more gas channels 1740 located at any circumferential positions along the interior of the fill tube 1710. The two or more gas channels 1740 may be symmetrically or asymmetrically positioned relative to each other along the interior of the fill tube 1710.

The bag former 1700 is used in processes to form, fill, and seal packaging for products, such as food (e.g. potato chips). After repeated use, the bag former 1700 needs to be cleaned. Cleaning the bag former 1700 is difficult due to the shape of the bag former 1700. It is especially difficult to clean the interior 1730 of the upper tapered section 1712 and the lower straight section 1713 of the fill tube 1710 through which the product flows during a bag forming operation. It is also especially difficult to clean the interior of the gas channels 1740. Accordingly, FIGS. 2-7 illustrate an exemplary embodiment of a bag former washing system and method.

Figure 2:
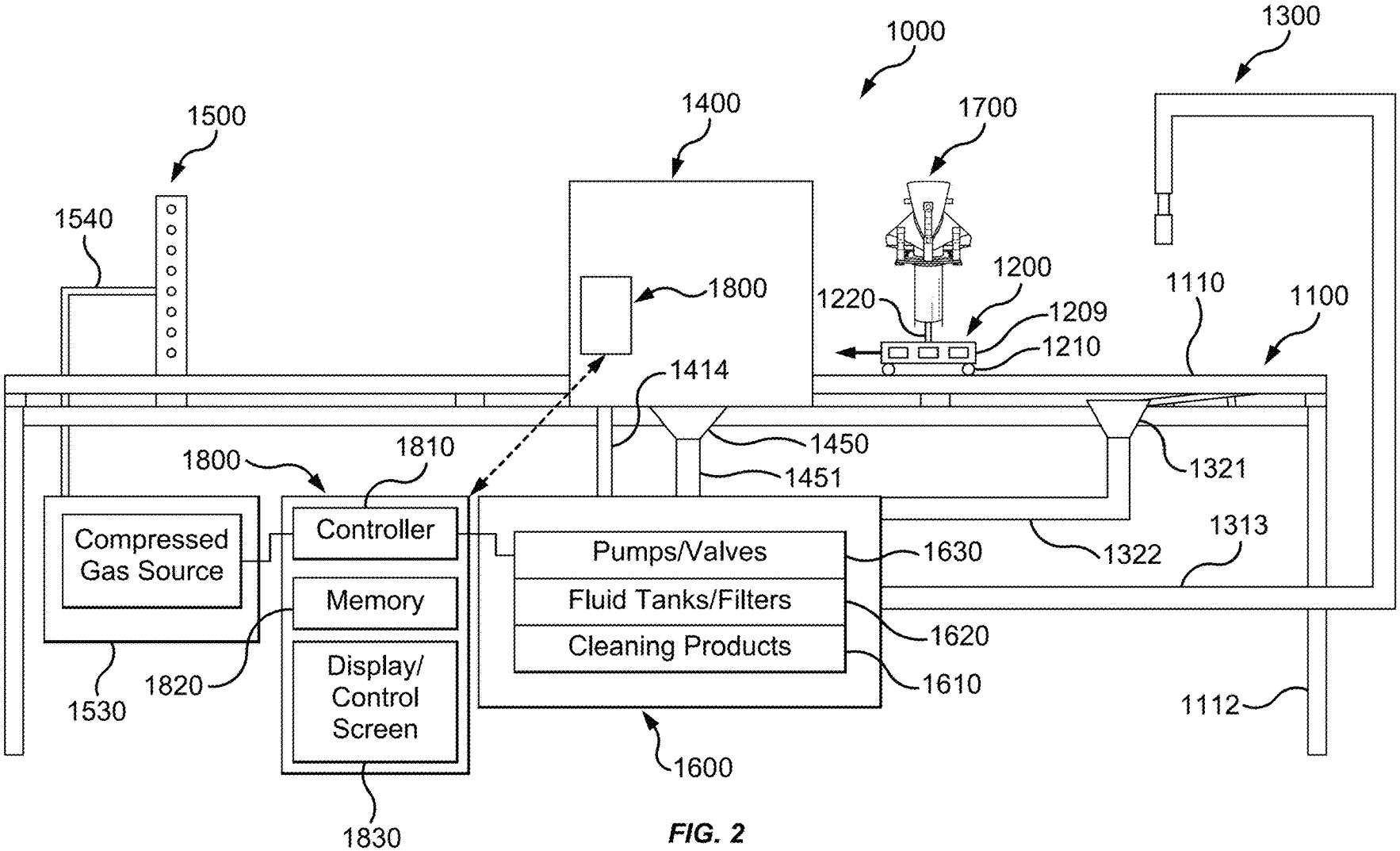
FIG. 2 illustrates a bag former washing system, according to one or more embodiments.

FIG. 2 illustrates a washing system 1000. Although the figures (such as FIG. 2) illustrate and this description makes reference to a washing system for bag formers 1700 and washing bag formers 1700, the system 1000 and later described method 2000 may be used to wash other packaging components including, but not limited to, product scale components (e.g. components used to weigh and hold product prior to directing the product through the bag former 1700). The washing system 1000 includes a track 1100, a cart 1200, a prewashing station 1300, a washing chamber 1400, a drying station 1500, at least one cleaning supply system 1600, and a control system 1800.

The track 1100 extends from one end of the washing system 1000 to the other and may be disposed on a support frame 1112. The track 1100 includes at least one rail 1110 extending the length of the track 1100. The track 1100 is used to guide the cart 1200 through the washing system 1000 from one end to another, and back. The track 1100 is used to guide the cart 1200 through the prewashing station 1300, the washing chamber 1400, and the drying station 1500.

The cart 1200 is disposed on the track 1100. In one or more embodiments, the cart 1200 is removable from the track 1100. The cart 1200 includes a platform 1209 and one or more wheels 1210 coupled to the platform 1209. The wheels 1210 allow the cart 1200 to laterally move along the track 1100. The wheels 1210 are disposed in the at least one rail 1110, which guides the wheels 1210 with the platform 1209 along the track 1100.

The cart 1200 also includes a mounting fixture 1220 coupled to the platform 1209 and therefore also moves along the track 1100. The mounting fixture 1220 is shaped to hold the bag former 1700 in a fixed position. Any number of bag formers 1700 can be coupled to and removed from the mounting fixture 1220. The bag former 1700 may be coupled to the mounting fixture 1220 by coupling methods including, but not limited to, fasteners, clamps, interference fits between components of the bag former 1700 and the mounting fixture 1200, and/or combinations thereof. The mounting fixture 1220 can be permanently affixed to the cart 1200, or can be removably coupled to and from the cart 1200 such that the bag former 1700 can be coupled to the mounting fixture 1220 first, and then the mounting fixture 1200 with the bag former 1700 can be coupled to the cart 1200.

The mounting fixture 1220 is configured to hold the bag former 1700 in the fixed position when the washing system 1000 is in use. The same mounting fixture 1220 may be adjusted to hold the bag former 1700 in different positions, and/or multiple different mounting fixtures 1220 can be interchangeably used depending on the desired position the bag former 1700 should be in during a wash cycle. The mounting fixture 1220 is illustrated as holding the bag former 1700 in an upright, vertical position. However, the mounting fixture 1220 may be configured to hold the bag former 1700 in a horizontal position and/or at an angle between the vertical and horizontal positions.

When the bag former 1700 is coupled to the mounting fixture 1220, the bag former 1700 can be moved laterally along the track 1100 through the washing system 1000. An operator can manually move the cart 1200 with the bag former 1700 coupled to the mounting fixture 1220 along the track 1100, and/or a motorized drive system can be used to move the cart 1200. The cart 1200 and the track 1100 may both have openings and gaps to allow for cleaning product, such as a combination of water and cleaning detergent, to both be sprayed onto the bag former 1700 from underneath and also for cleaning product to drain from the bag former 1700 and cart 1200.

The cleaning supply system 1600 comprises one or more pump/valves 1630, one or more fluid tanks/filters 1620, and one or more cleaning products 1610. The cleaning products 1610 may include water and/or various cleaning solid or liquid cleaning detergents. Any one or more of the cleaning products 1610 can be stored, mixed, filtered, and/or recycled in one or more of the fluid tanks/filters 1620. The pumps/valves 1630 are configured to control the supply and return of the cleaning products 1610 between the fluid tanks/filters 1620, the prewashing station 1300, and the washing chamber 1400.

The cleaning products 1610 can be pumped to the prewashing station 1300 via one or more fluid lines 1313, and returned to the fluid tanks/filters 1620 via one or more drains 1321 and fluid lines 1322. The cleaning products 1610 can be pumped to the washing chamber 1400 via one or more fluid lines 1414, and returned to the fluid tanks/filters 1620 via one or more drains 1450 and fluid lines 1451. The cleaning supply system 1600 is configured to use a minimal amount of water, which may at least partially be recycled and re-used for subsequent washing cycles.

The control system 1800 is used to control the operation of the washing system 1000. The control system 1800 may be disposed on an exterior surface of the washing chamber 1400 or positioned as a stand-alone panel, both for ease of access by an operator. The control system 1800 is configured to operate the pumps/valves of the cleaning supply system 1600 to supply the cleaning products 1610 to the washing chamber 1400 during a washing cycle. The control system 1800 includes a controller 1810, a memory 1820, and a display/control screen 1830. The display/control screen can be a touch-screen and/or include one or more input devices, such as control buttons/switches, keypads, keyboards, etc. The controller 1810 may include a processor configured to read/execute instructions to perform all or some of the processes associated with the washing system 1000. The memory 1820 may be configured to store instructions and information associated with performing all or some of the processes associated with the washing system 1000. An operator can input instructions via the display/control screen 1830 to control operation of the pumps/valves 1630 to conduct a washing cycle.

The control system 1800 is used to begin, stop, and/or set up the washing system 1000. The control system 1800 is used for, but not limited to, starting the supply of the cleaning products 1610 to the washing system 1000, turning on the prewashing station 1300, turning off the prewashing station 1300, turning on the washing chamber 1400, turning off the washing chamber 1400, beginning the wash cycle, stopping the wash cycle, starting the drying station 1500, and or stopping the drying station 1500. In one or more embodiments, the control system 1800 may be configured to control the supply of a compressed gas from a compressed gas source 1530 via one or more fluid lines, such as an air hose 1540. In one or more embodiments, the control system 1800 is used to automate all or some of the processes associated with the washing system 1000. In one or more embodiments, the control system 1800 may automate movement of the cart 1200 via a motorized drive system.

Figure 3:
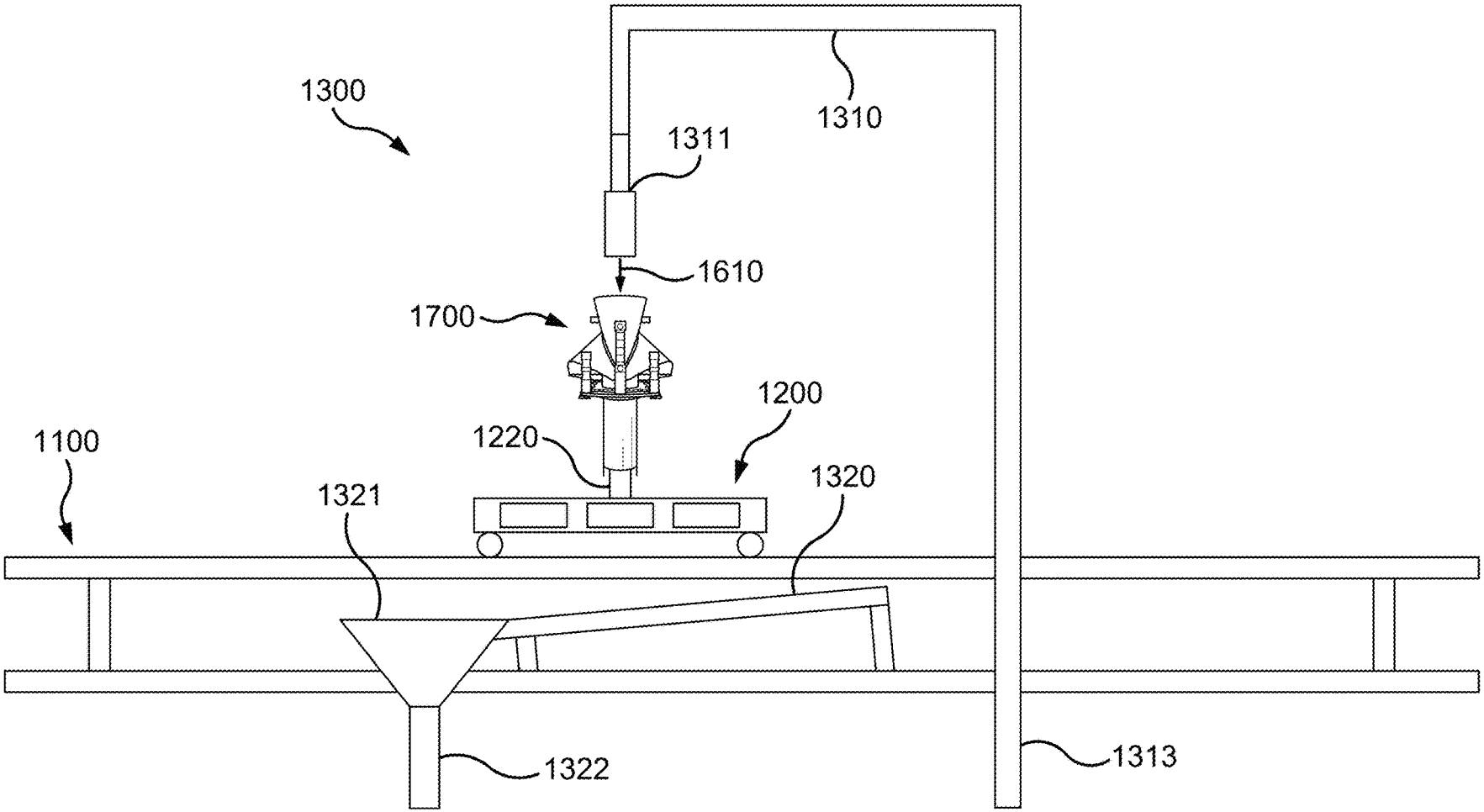
FIG. 3 illustrates a prewashing station of the bag former washing system of FIG. 2, according to one or more embodiments.

FIG. 3 illustrates the prewashing station 1300, according to one or more embodiments. The prewashing station 1300 includes a fluid line, such as a hose 1310 with a nozzle 1311 at a distal end of the hose 1310 and a collection tray 1320. The cleaning product 1610, such as water, is supplied to the hose 1310 via the fluid line 1313. The track 1100 runs the length of the prewashing station 1300 so that the cart 1200 may be positioned within the prewashing station 1300. The track 1100 is disposed above the collection tray 1320 and below the hose 1310. The hose 1310 is coupled to the at least one cleaning supply system 1600 via the one or more fluid lines 1313. The cleaning product 1610 is supplied to the hose 1310 via the one or more fluid lines 1313 from the cleaning supply system 1600 and is used to prewash the bag former 1700 in the prewashing station 1300. The cleaning products 1610 are sprayed from the nozzle 1311 and directed at the bag former 1700.

An operator may, optionally, manually prewash the bag former 1700 with the hose 1310 when the bag former 1700 is mounted to the cart 1200 and is in the prewashing station 1300. An operator may manually hold and move the hose 1310 and the nozzle 1311 to pre-wash the bag former 1700. The collection tray 1320 is disposed below the track 1100 and collects the cleaning products 1610 that have been sprayed from the nozzle 1320 during the prewashing of the bag former 1700. The collection tray 1320 is angled toward the one or more drains 1321 and fluid lines 1322. The angle of the collection tray 1320 allows for the cleaning products 1610 that have been collected in the collection tray 1320 to be directed toward the one or more drains 1321 using gravity.

After the bag former 1700 is prewashed, the cart 1200 is moved to the washing chamber 1400 along the track 1100 for a desired number of wash cycles.

Figure 4:
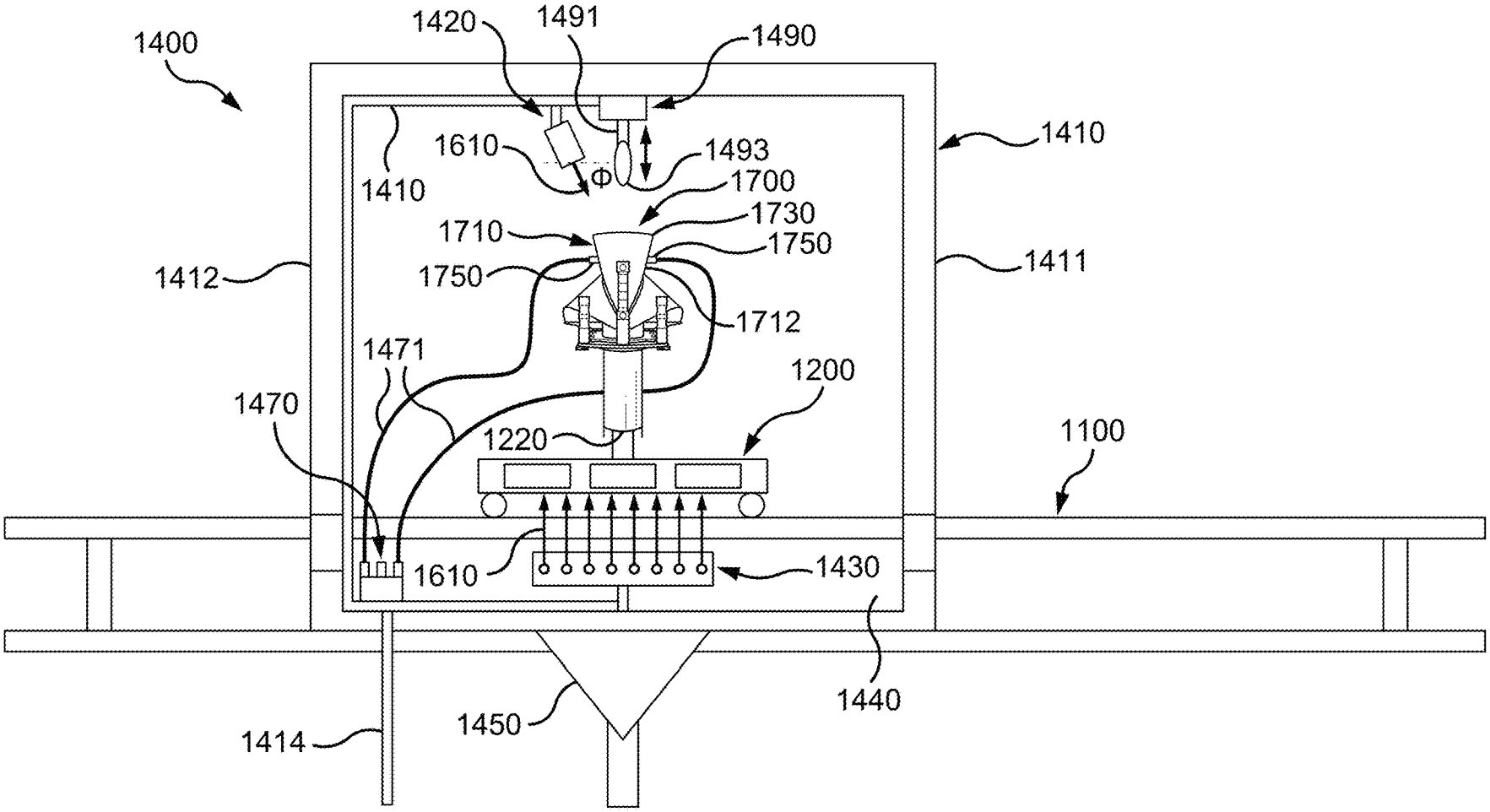
FIG. 4 illustrates a washing chamber of the bag former washing system of FIG. 2, according to one or more embodiments.

FIG. 4 illustrates the washing chamber 1400, according to one or more embodiments. The front wall of the washing chamber 1400 is removed in FIG. 4 to illustrate the interior components. The track 1100 extends through the washing chamber 1400. In one or more embodiments, the track 1100 may comprise a first section on one side of the washing chamber 1400, a second section inside of the washing chamber 1400, and a third section on the opposite side of the washing chamber 1400.

The washing chamber 1400 includes an enclosure 1410 with a first door 1411 and a second door 1412. The first door 1411 is located on the same side of the enclosure 1410 as the prewashing station 1300. The first door 1411 can open to allow the cart 1200 to move along the track 1100 into the enclosure 1410. The first door 1411 may then be closed to enclose the cart 1200 and the bag former 1700 in the enclosure 1410 to begin a wash cycle. The second door 1412 is opened to allow the cart 1200 to move along the track 1100 out of the enclosure 1410 after the bag former 1700 has gone through a desired number of wash cycles in the washing chamber 1400. During the wash cycle, the second door 1412 is also closed to enclose the cart 1200 and the bag former 1700 in the enclosure 1410. An operator can manually open and close the first door 1411 and/or the second door 1412.

Inside the enclosure 1410, the washing chamber 1400 includes a nozzle 1420, an adapter 1470, a rotating sprayer head 1430, a brush 1490, and a collection base 1440. The nozzle 1420 is disposed at the top of the enclosure 1410, and the rotating sprayer head 1430 is disposed at the bottom of the enclosure 1410 below the track 1100. In one or more embodiments, the rotating sprayer head 1430 is also or alternatively located at the top of the enclosure 1410. When the bag former 1700 is moved into the enclosure 1410 and before closing the first door 1411, an operator may connect one end of or more fluid lines 1471 (such as hoses) to the adapter 1470, and the opposite end of the fluid lines 1471 to the corresponding gas channel fittings 1750 of the bag former 1700. The operator may also make the fluid line connections through the second door 1421. The fluid lines 1471 may also already be disposed in the enclosure 1410 and connected to the adapter 1470 such that only the connection to the gas channel fittings 1750 need to be made by the operator before a wash cycle.

During a wash cycle, the nozzle 1420, the rotating sprayer head 1430, the adapter 1470, and the brush 1490 are supplied with cleaning products 1610 from the cleaning supply system 1600 via the one or more fluid lines 1414. The nozzle 1420 and the rotating sprayer head 1430 are configured to spray the cleaning products 1610 into the enclosure 1410 to wash the bag former 1700. The adapter 1470 is configured to supply cleaning products 1610 through the fluid lines 1471, which are coupled to the gas fittings 1750 of the former 1700, to flush the gas channels 1740 with the cleaning products 1610. The fluid lines 1471 are sized to match the gas channel fittings 1750 and may be any number of diameters including, but not limited to, about 0.125 inches to about 1.0 inch.

The brush 1490 is disposed at the top of the enclosure 1410 above the bag former 1700 and is used to clean the interior of the fill tube 1730. The brush 1490 is movable relative to the enclosure by a drive mechanism 1491 that moves a brush head 1492 of the brush 1490 downward towards the fill tube 1710 so that it may be run into and out of the fill tube 1710 in operation. The drive mechanism 1491 may also cause the brush head 1492 to rotate while being raised and/or lowered. Actuation of the drive mechanism 1491 may be controlled by the control system 1800. The brush head 1492 may also include fluid ports through which cleaning product 1610 can be supplied to spray while cleaning. The brush head 1492 may be sized to clean both the tapered section 1712 of the fill tube 1710 and the straight section 1713 of the fill tube 1710.

The nozzle 1420 is positioned above the bag former 1700 and can be oriented at any angle of $\phi$ (between 0 degrees and 180 degrees) from the horizontal axis. The nozzle 1420 is positioned so that when the cart 1200 is in the enclosure 1410, the bag former 1700 is in the desired orientation and position to be sprayed by the cleaning products 1610. The nozzle 1420 and/or the bag former 1700 can be positioned such that the cleaning products 1610 are sprayed into the interior 1730 of the upper tapered section 1712 of the fill tube 1710 at a desired angle. The nozzle 1420 itself and/or the spray from the nozzle 1420 can be oriented any angle of ¢ (between 0 degrees and 180 degrees). Although only one nozzle 1420 is illustrated, any number of nozzles 1420 can be positioned in the enclosure 1410 and at any location within the enclosure 1410 depending on the orientation of the bag former 1700 (and/or multiple bag formers) when mounted on the cart 1200.

Figure 5A:
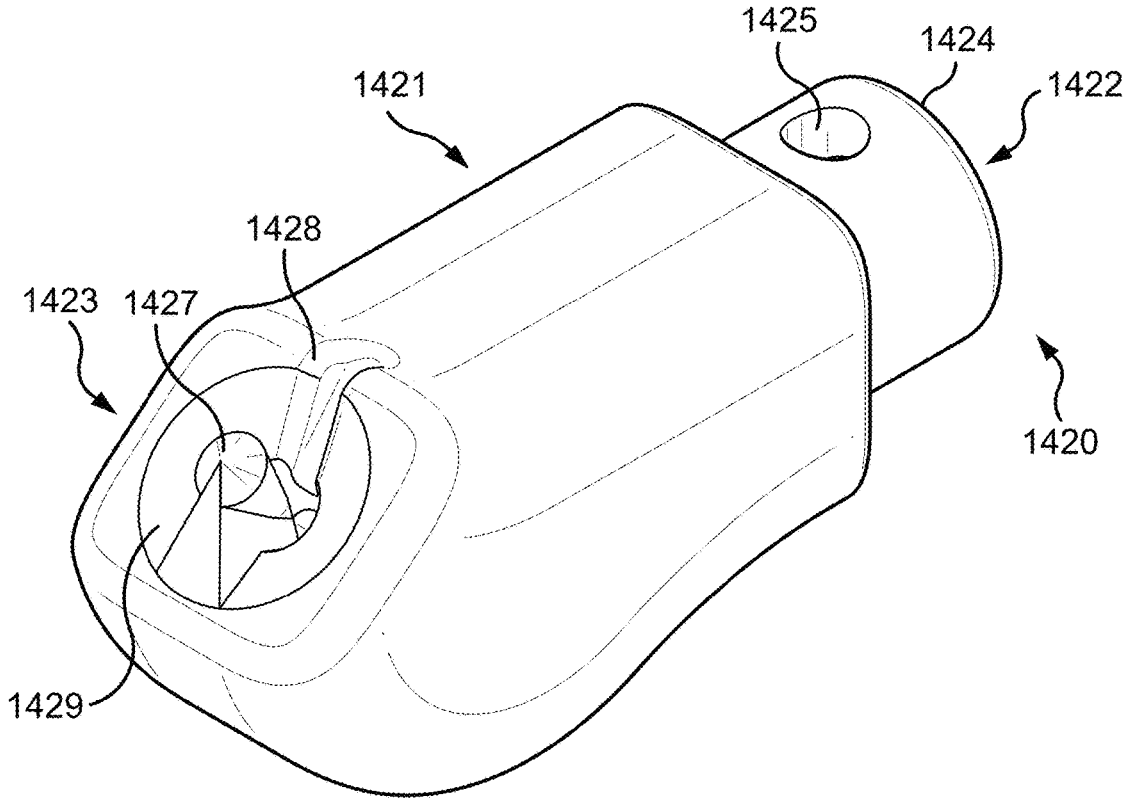
FIG. 5A illustrates a perspective view of a nozzle of the washing chamber of FIG. 4, according to one or more embodiments.
Figure 5B:
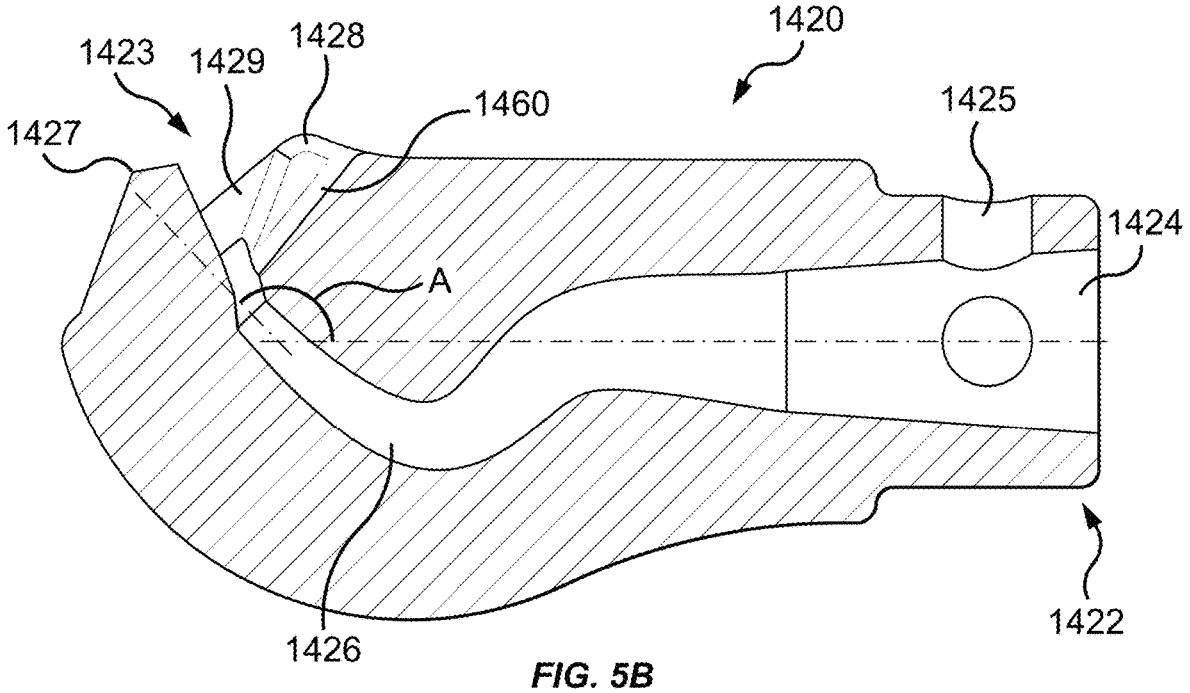
FIG. 5B illustrates a cross-section of the nozzle of FIG. 5A, according to one or more embodiments.

FIG. 5A-5B illustrates an exemplary nozzle 1420 for use inside the washing chamber 1400. The nozzle 1420 has a body 1421 with an inlet 1422 at one end and an outlet 1423 at another. The body 1421 also includes attachment holes 1425 that are perpendicular to the inlet 1422 that allow the nozzle 1420 to be coupled to the enclosure 1410, such as by threaded fastener or pinned connection. The inlet 1422 is supplied the cleaning products 1610 via the one or more fluid lines 1410 from the cleaning supply system 1600, and the outlet 1423 sprays the cleaning products 1610 towards the bag former 1700 during a wash cycle. The inlet 1422 includes a main bore 1424. The main bore 1424 of the inlet 1422 has a decreasing diameter and has a central axis that is horizontal. The outlet 1423 is angled upwards with an increasing diameter. That is, the outlet 1423 has a central axis that is at an angle A (between 0 degrees and 180 degrees) relative to the central axis of the inlet 1422. A flow path 1426 connects the inlet 1422 and the outlet 1423. The flow path 1426 decreases in diameter from the inlet 1422 to the outlet 1423 and may have multiple changes in direction between the inlet 1422 and the outlet 1423. From the inlet 1422, the flow path 1426 may sweep upwards and downwards within the nozzle 1420 before reaching the outlet 1423.

The outlet 1423 is generally conical with a conical surface 1429, wherein the diameter of the outlet 1423 increases from the ending diameter of the flow path 1426. The outlet 1423 includes a fluid splitter 1427 in the center of the outlet 1423 and attached to a portion of the conical surface 1429 of the outlet 1423 so that cleaning products 1610 leaving the nozzle 1420, leave the nozzle 1420 in a generally hollow conical shape.

The outlet 1423 also includes at least one recess 1428 in the conical surface 1429 of the outlet 1423. The recess 1428 is a slot cut into a portion of the conical surface 1429. There is only one recess 1428 with a flat base 1460 cut into the top portion of the conical surface of the outlet 1423 in the presently illustrated embodiment but the outlet 1423 may include multiple recesses 1428.

Figure 5C:
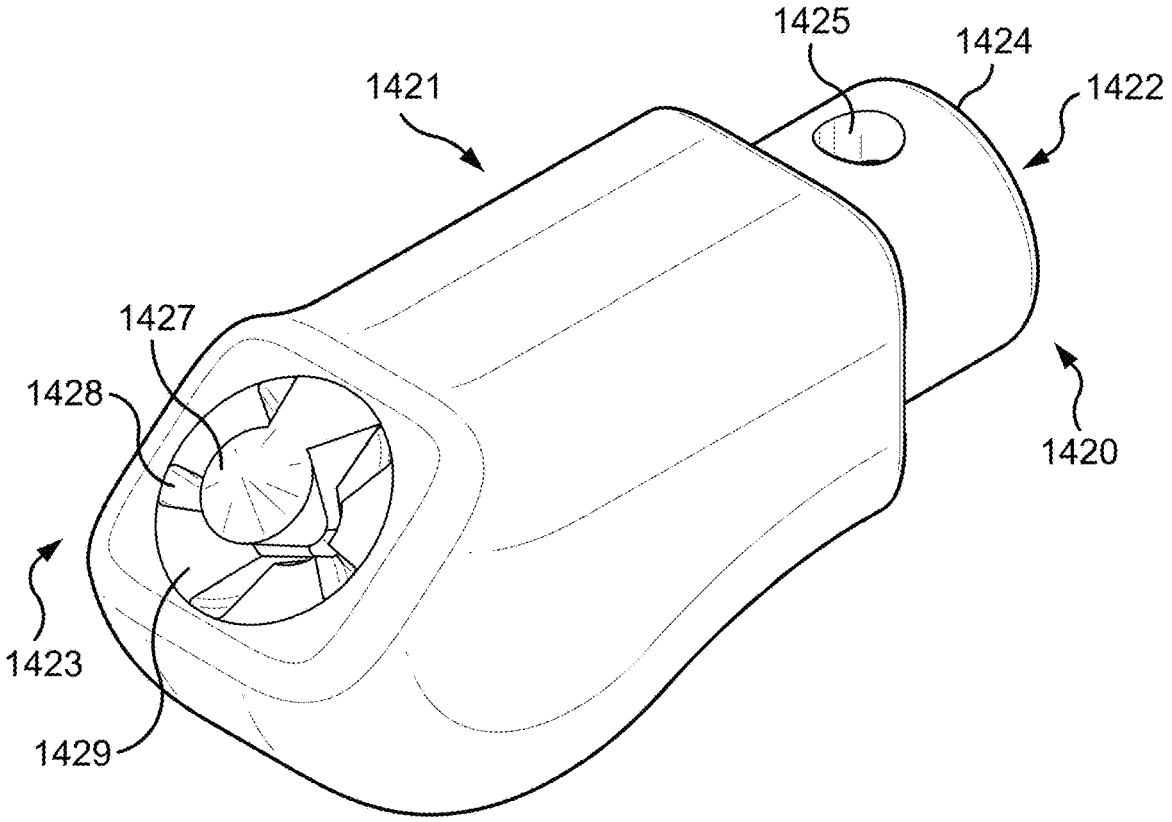
FIG. 5C illustrates a perspective view of another nozzle of the washing chamber of FIG. 4, according to one or more embodiments.
Figure 5D:
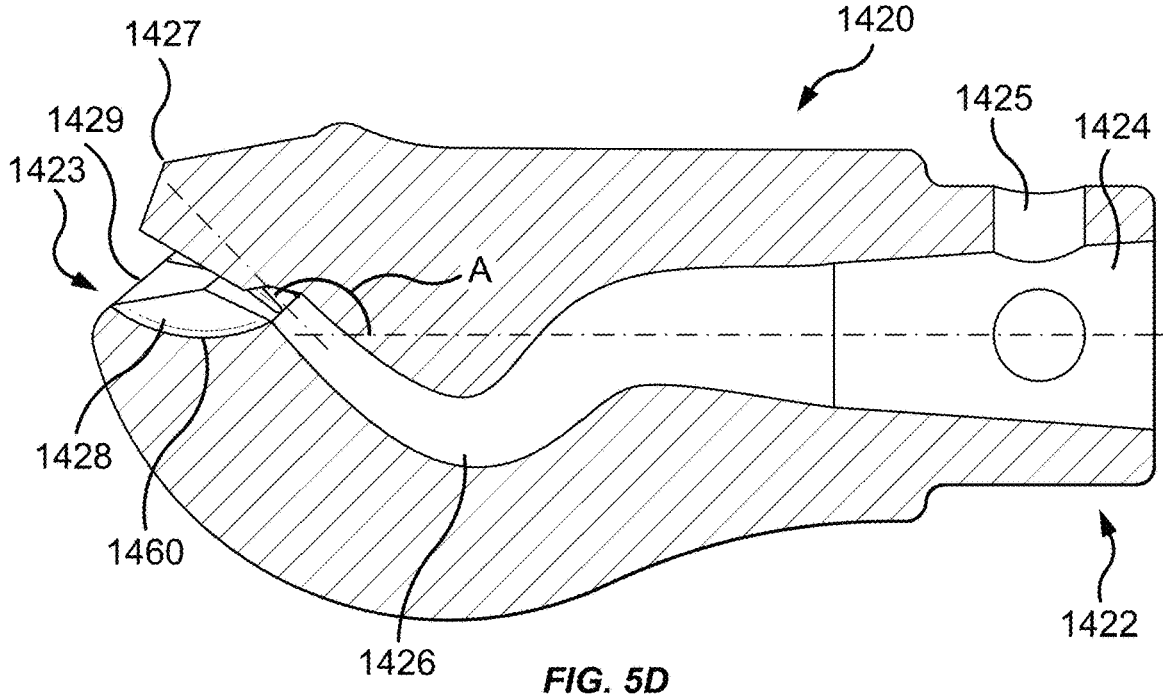
FIG. 5D illustrates a cross-section of the nozzle of FIG. 5C, according to one or more embodiments.

FIG. 5C-5D illustrates another exemplary nozzle 1420 for use inside the washing chamber 1400. The nozzle 1420 illustrated in FIGS. 50-5D is similar to the nozzle 1420 illustrated in FIGS. 5A-5B. However, the fluid splitter 1427 is larger, the outlet 1423 contains three recesses 1428 cut in the bottom portion of the conical surface 1429 of the outlet 1423, and the recesses 1428 are rounded at their base 1460.

Figure 6A:
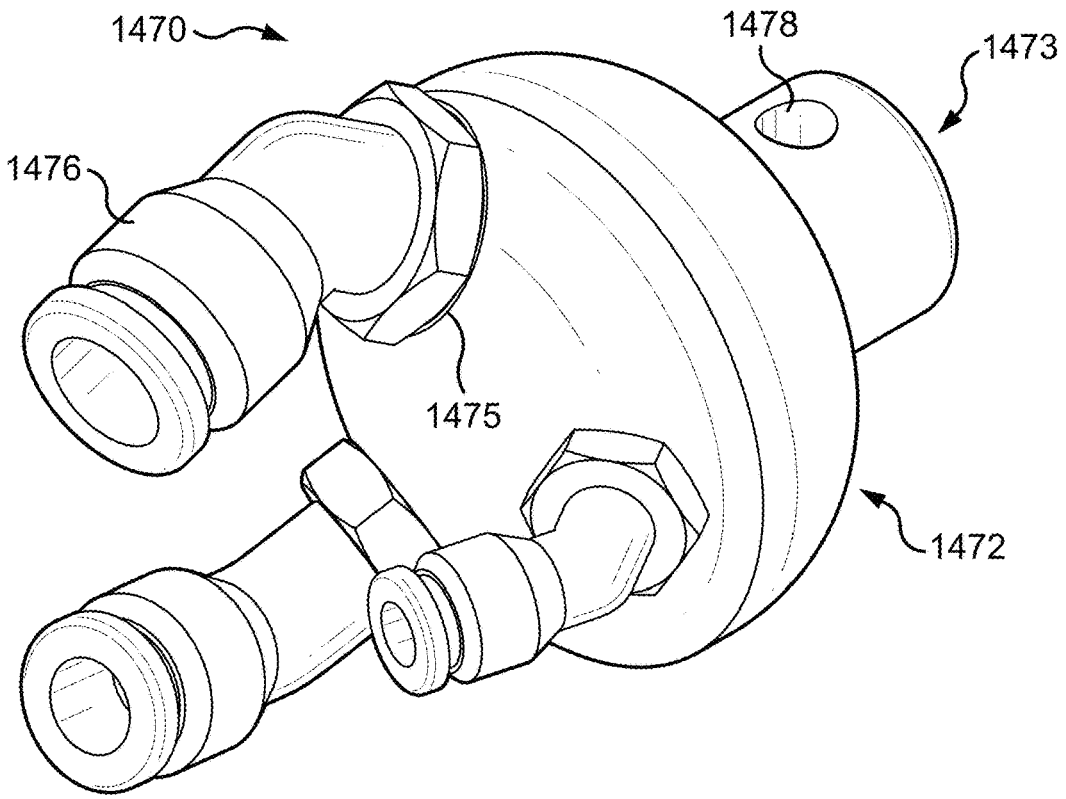
FIG. 6A illustrates a perspective view of an adapter of the bag former washing system of FIG. 2, according to one or more embodiments.
Figure 6B:
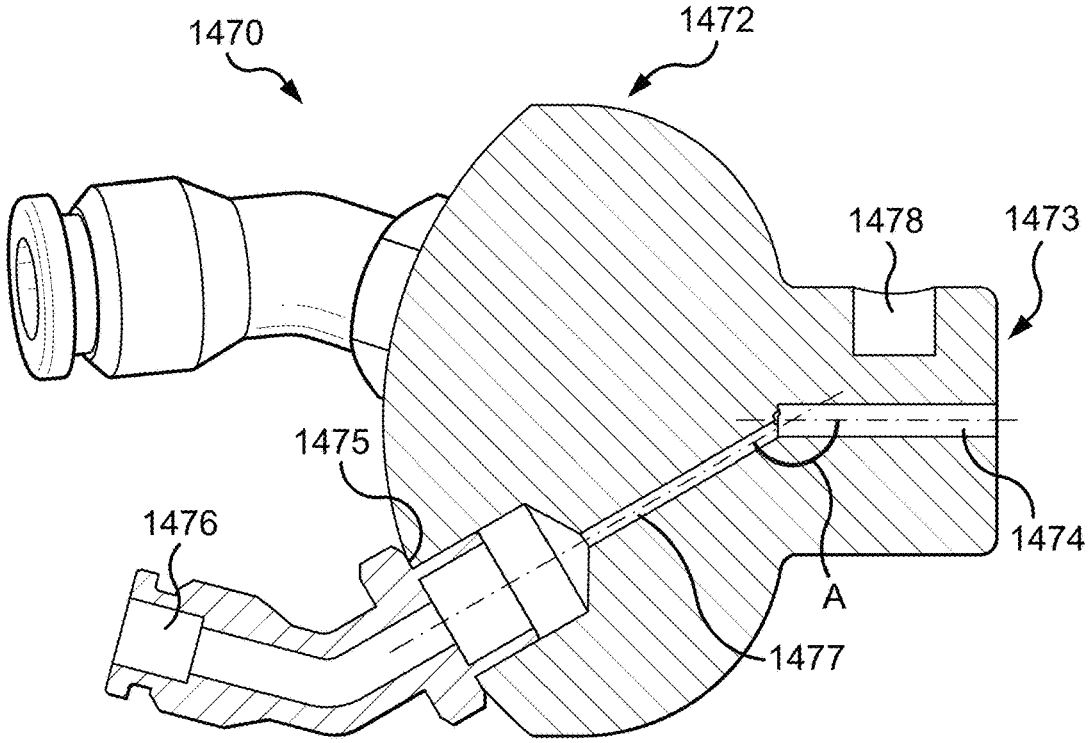
FIG. 6B illustrates a cross-section of the adapter of FIG. 6A, according to one or more embodiments.

FIGS. 6A-B illustrates an adapter 1470 according to one embodiment. The adapter 1470 is used to connect and supply the cleaning product 1610 the fluid line 1414 to the one or more fluid lines 1471 to flow through and clean the gas channels 1740 of the bag former 1700. The adapter 1470 includes a body 1472 with an inlet 1473 at one end having a main bore 1474, and includes attachment holes 1478 that are perpendicular to the main bore 1474 for attaching the adapter 1470 to the enclosure 1410.

The adapter 1470 also includes at least one outlet 1475 at the end opposite the inlet 1473. In the illustrated embodiment, the adapter 1470 may include multiple outlets 1475 spaced apart from one another in any number of patterns. The outlets 1475 are sized and configured to receive fluid lines 1471 as shown in FIG. 4. The outlets 1475 may be any number of diameters including, but no limited to, about 0.125 inches to about 1.0 inch. The outlets 1475 may have different diameters. In one or more embodiments, the adapter 1470 includes one or more fittings 1476 coupled to (such as threaded into) the outlets 1475. The fittings 1476 at least partially extend from the outlets 1475 and are configured to receive the fluid lines 1471. The fittings 1476 may be quick connect/disconnect fittings for ease of assembly and operation. The fittings 1476 may vary in size, shape, diameter, and length from one another.

At least one flow path 1477 connects the main bore 1474 to the at least one outlet 1475. Each outlet 1475 may have its own flow path 1477 connecting it to the main bore 1474. The flow paths 1477 may be angled at an angle A from the main bore 1474. The angle A may be between 0 and 180 degrees. Similar to the outlets 1475 and the fittings 1475, the diameter of the flow paths 1477 may be different from one another. The diameter of the flow paths 1477 also may vary along the length of the flow path 1477.

In use, the adapter 1470 receives cleaning product at the inlet 1473, directs the cleaning product through the main bore 1474, through the one or more flow paths 1477, out of the one or more outlets 1475, out of the fittings 1476 if included, and into at least one fluid line 1471 attached to the fittings 1476 and/or the outlets 1475. The fluid line 1471 then directs the cleaning product to the gas channel fittings 1750 of the bag former 1700 which direct the cleaning product through the gas channels 1740 of the bag former 1700.

Figure 6C:
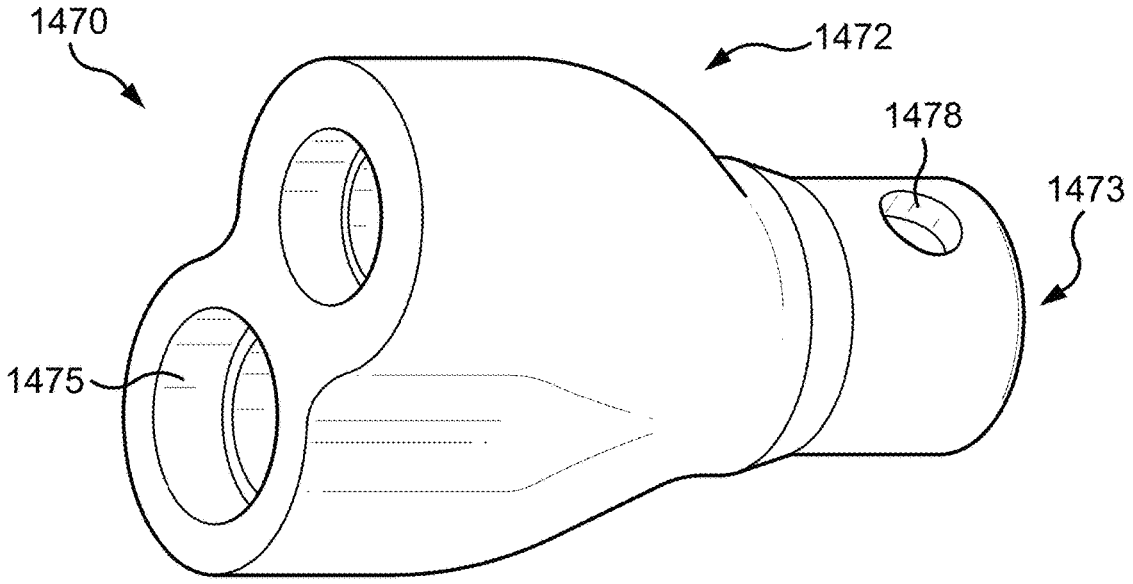
FIG. 6C illustrates a perspective view of another adapter of the bag former washing system of FIG. 2, according to one or more embodiments.
Figure 6D:
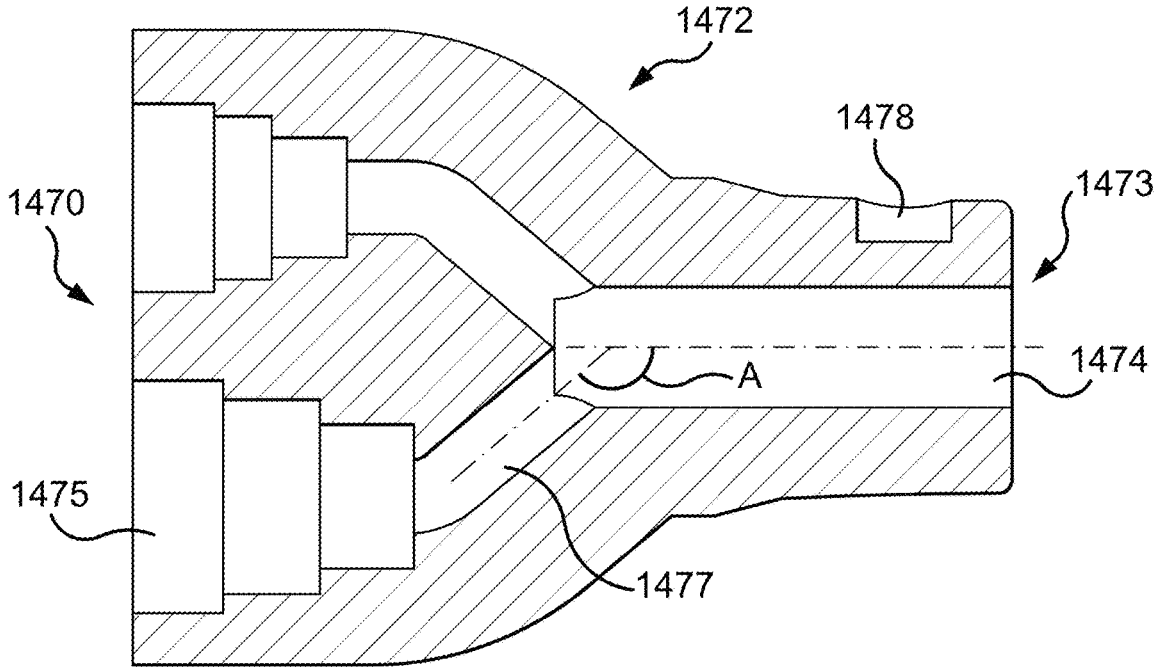
FIG. 6D illustrates a cross-section of the adapter of FIG. 6C, according to one or more embodiments.

FIGS. 6C-D illustrate another exemplary adapter 1470, the operation of which is similar to the adapter 1470 illustrated in FIGS. 6A-6B and will not be repeated for brevity. The adapter 1470 of FIGS. 6C-6D includes two parallel spaced outlets 1475. The two outlets 1475 may have different inner diameters for connection to different sized fittings and/or fluid lines. The adapter 1470 may include fittings similar to fittings 1476 shown in FIGS. 6A-6B, and such fitting may extend from the outlets 1475 and/or may be fully recessed within the bores of the outlets 1475.

Figure 6E:
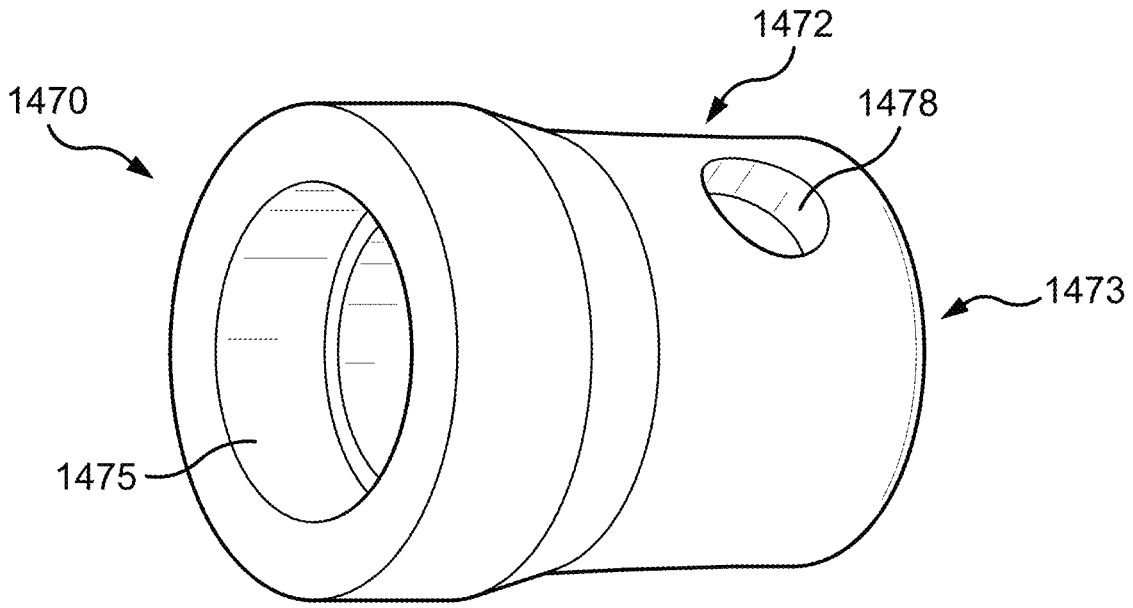
FIG. 6E illustrates a perspective view of another adapter of the bag former washing system of FIG. 2, according to one or more embodiments.
Figure 6F:
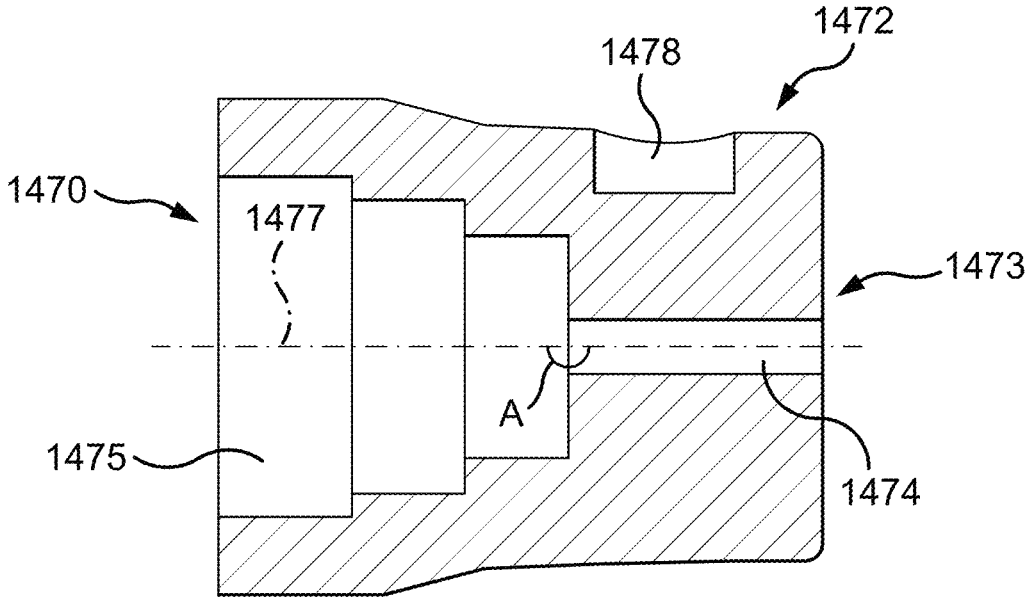
FIG. 6F illustrates a cross-section of the adapter of FIG. 6E, according to one or more embodiments.

FIGS. 6E-6F illustrate another exemplary adapter 1470, the operation of which is similar to the adapter 1470 illustrated in FIGS. 6A-6B and will not be repeated for brevity. The adapter 1470 of FIGS. 6E-6F includes a single outlet 1475 that is parallel to the main bore 1474. The adapter 1470 may include fittings similar to fittings 1476 shown in FIGS. 6A-6B, and such fitting may extend from the outlets 1475 and/or may be fully recessed within the bores of the outlets 1475.

With reference back to FIG. 4, during a washing cycle, the nozzle 1420 sprays cleaning products 1610 towards the bag former 1700 to clean the interior 1730 of the upper tapered section 1712 of the fill tube 1710. The nozzle 1420 can spray continuously throughout the wash cycle, in bursts, or at discrete points in time.

The rotating sprayer head 1430 has a plurality of holes that direct cleaning products 1610 upward. During a wash cycle, the rotating sprayer head 1430 simultaneously rotates about a vertical axis while spraying cleaning products 1610 around the entirety of the enclosure 1410.

During the wash cycle, the adapter 1470 directs cleaning product 1610 via the fluid lines 1471 through the gas channels 1740 of the bag former 1700. During the wash cycle, the brush 1490 may be rotated and lowered into the fill tube 1710 to clean the interior 1730.

While the bag former 1700 and cart 1200 are in the washing chamber 1400, an operator initiates a wash cycle which includes, but is not limited to, the nozzle 1420 spraying cleaning products 1610 toward the bag former 1700, the adapter 1470 directing cleaning products 1610 to the gas channels 1740 of the bag former 1700, and optionally the rotating sprayer head 1430 and/or the brush 1490, spraying cleaning products 1610 towards and cleaning the bag former 1700 and spraying cleaning products 1610 around the enclosure 1410 of the washing chamber 1400. The wash cycle may also optionally include draining the cleaning products 1610 from the washing chamber 1400 via the one or more drains 1450 and rinsing the bag former 1700 with sanitizer products and/or rinse-aid products. The sanitizer product is configured to sanitize the bag former 1700 and the rinse-aid product is configured to help rinse off any residual cleaning products 1610 from the bag former 1700. The sanitizer product and/or the rinse-aid products may be similarly stored, mixed, filtered, and/or recycled in one or more of the fluid tanks/filters 1620. The pumps/valves 1630 are configured to control the supply and return of the sanitizer products and/or the rinse-aid products between the fluid tanks/filters 1620, the prewashing station 1300, and the washing chamber 1400. The sanitizer products and/or the rinse-aid products can be pumped to the prewashing station 1300 via one or more fluid lines 1313, sprayed from the nozzle 1311, and returned to the fluid tanks/filters 1620 via one or more drains 1321 and fluid lines 1322. The sanitizer products and/or the rinse-aid products can be pumped to the washing chamber 1400 via one or more fluid lines 1414, sprayed from the nozzle 1420 and/or the rotating sprayer head 1430, and returned to the fluid tanks/filters 1620 via one or more drains 1450 and fluid lines 1451. A wash cycle time may be within a time range of 1 minute to 10 minutes, such as 2, 3, or 5 minutes.

The collection base 1440 is disposed at the bottom of the enclosure 1410 and is used to collect the cleaning products 1610 that accumulate in the enclosure 1410 during a wash cycle. The collection base 1440 may be angled towards the one or more drains 1450 to allow the cleaning products 1610 that have been collected in the collection base 1440 to be directed toward the one or more drains 1450 using gravity.

After the bag former 1700 has gone through a desired number of wash cycles in the washing chamber 1400, the second door 1412 may be opened to allow the cart 1200 to move along the track 1100 out of the enclosure 1410 of the washing chamber 1400 to the drying station 1500.

Figure 7:
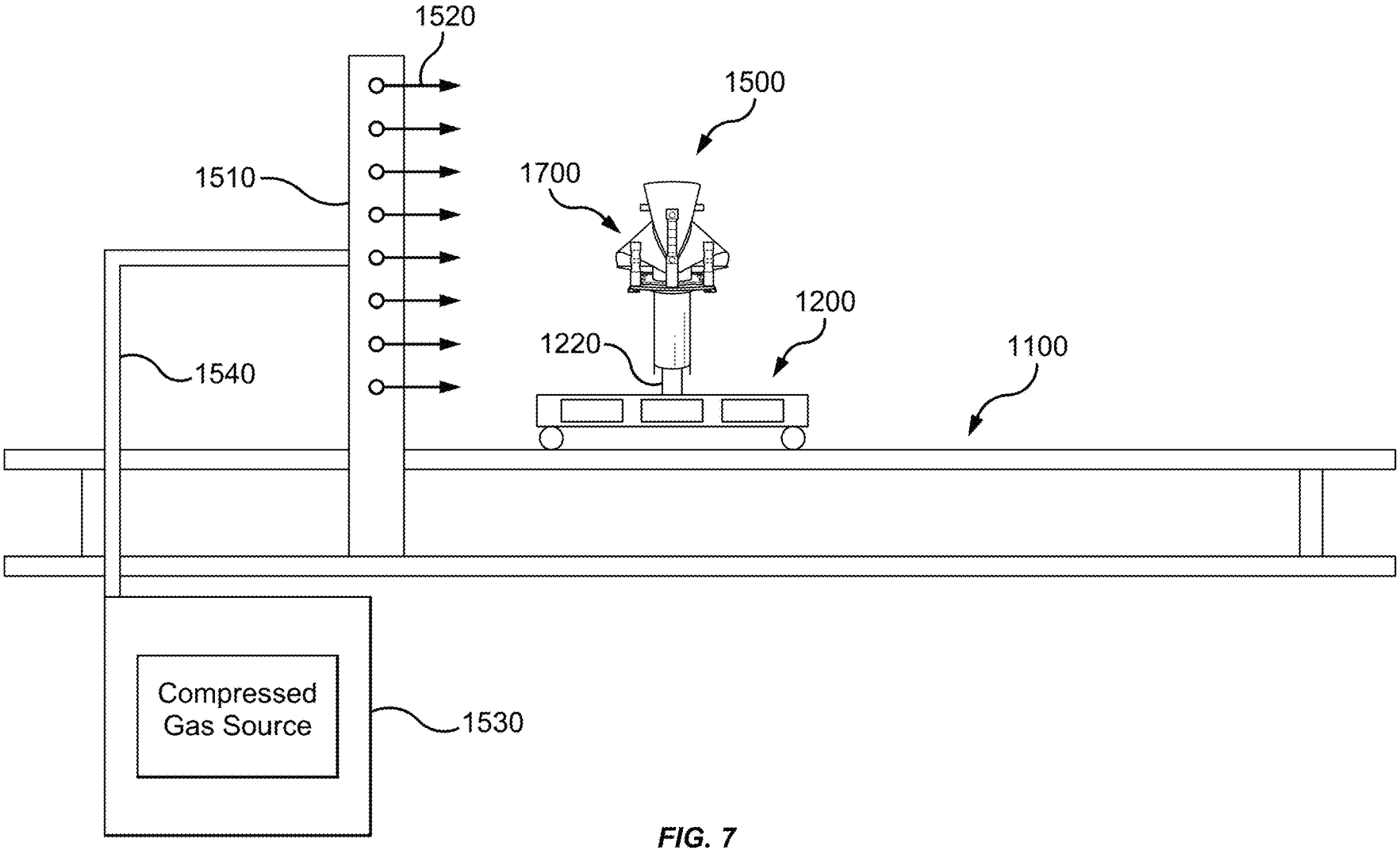
FIG. 7 illustrates a drying station of the bag former washing system of FIG. 2, according to one or more embodiments.

FIG. 7 illustrates the drying station 1500, according to one or more embodiments. The track 1100 extends to the drying station 1500. After the bag former 1700 is washed in the washing chamber 1400, the cart 1200 containing the bag former 1700 may be moved along the track 1100 to the drying station 1500. The drying station 1500 includes a dryer in the form of an air blade 1510, which may comprise a structure with a plurality of fluid paths disposed through and along a length of the structure. The air blade 1510 can be used to dry the bag former 1700 by blowing a compressed gas 1520 (e.g. air) on the bag former 1700 after it has been cleaned in the washing chamber 1400 and the prewashing station 1300. The air blade 1510 receives the compressed gas 1520 from an external source, such as the compressed gas source 1530 via one or more fluid lines, such as the air hose 1540. In one or more embodiments, the supplied compressed gas 1520 is supplied at a maximum of 150 psi. In one or more embodiments, one or more dryers (e.g. air blades 1510) may be positioned at various locations of the drying station 1500. In one or more embodiments, the drying station 1500 may include a hand held dryer (e.g. a blow dryer) instead of or in addition to one or more air blades 1510 and/or other types of stationary dryers that an operator may use to dry the bag former 1700.

After the bag former 1700 has been dried at the drying station 1500, it may be removed from the cart 1200 for use. It is also contemplated that the bag former 1700 may be moved back through the washing system 1000 if the bag former 1700 is not sufficiently clean or dry after one pass through the washing system 1000.

Figure 8:
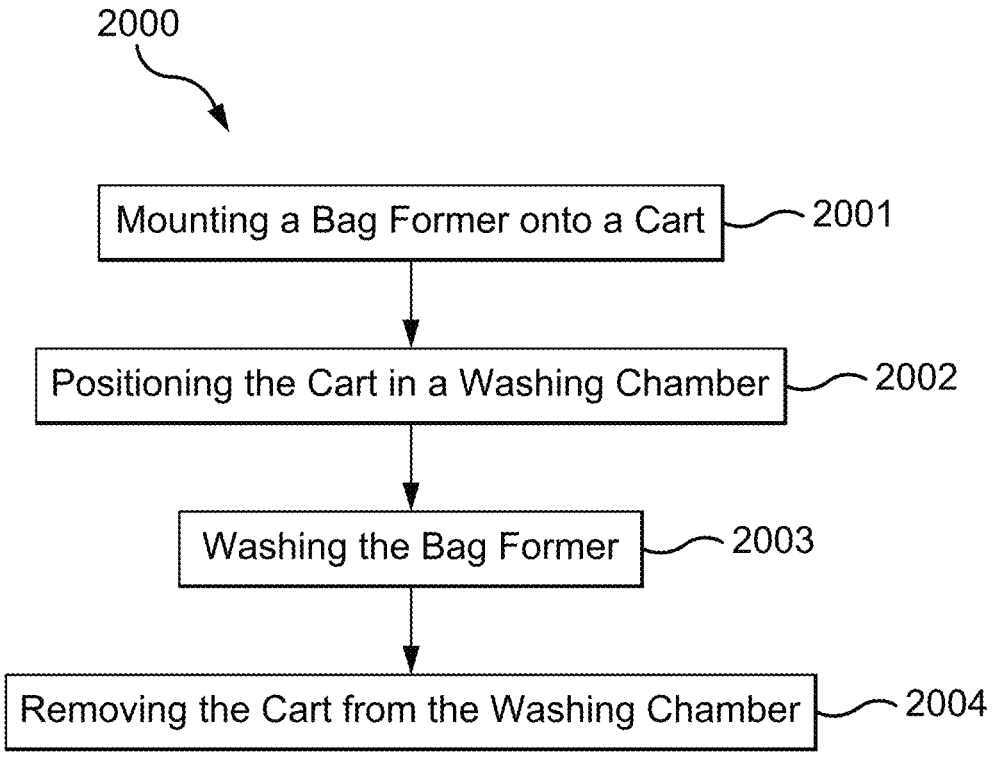
FIG. 8 illustrates a method for washing a bag former, according to one or more embodiments.

FIG. 8 illustrates a method 2000 for washing a bag former (such as bag former 1700 of FIG. 1) with a washing system (such as the washing system 1000 of FIG. 2), according to one or more embodiments.

At step 2001, the bag former is mounted onto a cart (such as cart 1200 of FIG. 2). The bag former is mounted onto the cart by coupling the bag former to a mounting fixture (such as mounting fixture 1220 of FIG. 2) so that the bag former is affixed to the cart at a desired angle and orientation for washing.

At step 2002, the cart is positioned into a washing chamber (such as washing chamber 1400 of FIG. 2). Positioning the cart in the washing chamber includes moving, such as rolling, the cart laterally along a track (such as track 1100 of FIG. 2) extending the length of the washing system towards the washing chamber, opening a first door of the washing chamber (such as first door 1411 of FIG. 4), and positioning the cart in the washing chamber. After the cart with the bag former is positioned in the washing chamber, one or more fluid lines (such as fluid lines 1471 of FIG. 4) may be connected at one end to one or more gas channel fittings (such as gas channel fittings 1750 of FIG. 4), and if not already connected, the opposite ends of the fluid lines may be connected to an adapter (such as adapter 1470 of FIG. 4), followed by closing the first door of the washing chamber.

At step 2003, the bag former is washed in the washing chamber. Washing the bag former includes using a control system (such as control system 1800) to begin a wash cycle. The wash cycle includes spraying the bag former with a washing chamber nozzle (such as nozzles 1420 of FIGS. 5A-5D) with a cleaning product (such as cleaning products 1610 of FIG. 4) and directing the cleaning product through gas channels (such as gas channels 1740 of FIG. 1B) of the bag former via the gas channel fittings and the one or more fluid lines attached to the adapter. The wash cycle also includes optionally spraying and distributing cleaning products using a rotating sprayer head (such as rotating sprayer head 1430 of FIG. 4) around the inside of the washing chamber and optionally cleaning the bag former with a brush (such as brush 1490 of FIG. 4) attached to the interior of the washing chamber. The nozzle is located at the top of the washing chamber above the bag former, and the rotating sprayer head is located at the bottom of the washing chamber below the bag former. The nozzle and/or the spray out of the nozzle is angled to spray cleaning products into an interior region of an upper tapered section of a fill tube of the bag former.

At step 2004, the cart is removed from the washing chamber. Removing the cart from the washing chamber includes opening a second door (such as second door 1412 of FIG. 2), disconnecting the fluid lines from the gas channel fittings, and moving, such as rolling, the cart laterally along the track out of the washing chamber, and closing the second door of the washing chamber.

In one or more embodiments, before positioning the cart into the washing chamber, the cart is positioned in a prewashing station (such as prewashing station 1300 of FIG. 3) where the bag former is prewashed. The prewashing station includes a hose (such as hose 1310 of FIG. 3) with a prewashing nozzle (such as nozzle 1311 of FIG. 3) used for prewashing the bag former. At the prewashing station, the bag former is prewashed by spraying cleaning products, which may be the same or different from the cleaning products used in the washing chamber on the bag former. Movement of the cart through the washing system may be done automatically or may be manually by an operator of the washing system.

In one or more embodiments, after removing the cart from the washing chamber, the cart may be positioned at a drying station (such as drying station 1500 of FIG. 7) to dry the bag former. The drying station includes an air blade (such as air blade 1510 of FIG. 7) to blow-dry the bag former with compressed gas (such as compressed gas 1520 of FIG. 7) supplied from an external source (such as external source 1530 of FIG. 7) via an air hose (such as air hose 1540 of FIG. 7).

In one or more embodiments, the controller of the control system is used to operate the washing system. Instructions stored on the memory may be read and executed by controller upon input by an operator to operate the washing system to accomplish any and/or all of the above referenced steps manually and/or automatically.

In one or more embodiments, the cart can be positioned in any of the stations and/or chambers in any order for any numbers of wash cycles, prewash cycles, and/or dry cycles.

Any one or more components of the washing system 1000 may be integrally formed together, directly coupled together, and/or indirectly coupled together and are not limited to the specific arrangement of components illustrated in FIGS. 1-6. Any one or more of the components, embodiments, or steps of the washing system 1000 and method 2000 may be combined in whole or part with any other components, embodiments, or steps of the washing system 1000 and method 2000.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A method for washing a bag former, comprising:

mounting a bag former onto a cart;

positioning the cart with the bag former in a washing chamber, the washing chamber comprising a washing chamber nozzle;

connecting one or more fluid lines to one or more corresponding gas channel fittings of the bag former when positioned in the washing chamber, wherein one end of the fluid lines is coupled to the corresponding gas channel fitting and an opposite end of the fluid lines is coupled to an adapter disposed in the washing chamber, and wherein the adapter includes one or more outlets to couple to the opposite end of the fluid lines;

washing the bag former with a cleaning product sprayed from the washing chamber nozzle, wherein the cleaning product is sprayed into an interior region of the bag former;

washing one or more gas channels of the bag former by supplying the cleaning product through the adapter, the one or more fluid lines, and the one or more corresponding gas channel fittings; and removing the cart with the bag former from the washing chamber.

2. The method of claim 1, wherein the interior region of the bag former is an interior of an upper tapered section of a fill tube of the bag former.

3. The method of claim 1, wherein:

positioning the cart in the washing chamber comprises moving the cart laterally along a track into the washing chamber; and removing the cart from the washing chamber comprises moving the cart laterally along the track out of the washing chamber.

4. The method of claim 1, further comprising washing the bag former with the same or a different cleaning product at a prewash station before positioning the cart in the washing chamber.

5. The method of claim 4, wherein:

the prewashing station comprises a hose coupled to a prewashing nozzle; and washing the bag former at the prewashing station comprises spraying the bag former with the same or the different cleaning product from the prewashing nozzle.

6. The method of claim 1, further comprising:

moving the cart with the bag former to a drying station after removing the cart from the washing chamber; and drying the bag former at the drying station.

7. The method of claim 1, wherein the adapter includes at least two, different sized outlets for connection to the fluid lines, for connecting to different sized gas channel fittings.

8. The method of claim 1, wherein the washing chamber nozzle comprises:

a body;

an inlet disposed at a first end of the body comprising a horizontal central axis;

a conical outlet with an increasing diameter disposed at a second end of the body comprising a central axis that is at an angle relative to the central axis of the inlet, wherein a flow path comprising varying diameters connects the inlet and the outlet;

a conical flow splitter with an increasing diameter disposed in the outlet and disposed along the central axis of the outlet; and at least one recess cut in a surface of the conical outlet.

9. The method of claim 8, wherein the at least one recess comprises a flat base surface.

10. The method of claim 8, wherein the at least one recess comprises a first recess and a second recess comprising rounded bases surfaces.

11. A method for washing a bag former, comprising:

mounting a bag former onto a cart;

positioning the cart with the bag former in a washing chamber, the washing chamber comprising a washing chamber nozzle, wherein the washing chamber nozzle comprises:

a body;

an inlet disposed at a first end of the body comprising a horizontal central axis;

a conical outlet with an increasing diameter disposed at a second end of the body comprising a central axis that is at an angle relative to the central axis of the inlet, wherein a flow path comprising varying diameters connects the inlet and the outlet;

a conical flow splitter with an increasing diameter disposed in the outlet and disposed along the central axis of the outlet; and at least one recess cut in a surface of the conical outlet;

washing the bag former with a cleaning product sprayed from the washing chamber nozzle, wherein the cleaning product is sprayed into an interior region of the bag former; and removing the cart with the bag former from the washing chamber.

12. The method of claim 11, wherein the at least one recess comprises a flat base surface.

13. The method of claim 11, wherein the at least one recess comprises a first recess and a second recess comprising rounded bases surfaces.

14. The method of claim 11, wherein the interior region of the bag former is an interior of an upper tapered section of a fill tube of the bag former.

15. The method of claim 11, wherein:

positioning the cart in the washing chamber comprises moving the cart laterally along a track into the washing chamber; and removing the cart from the washing chamber comprises moving the cart laterally along the track out of the washing chamber.

16. The method of claim 11, further comprising washing the bag former with the same or a different cleaning product at a prewash station before positioning the cart in the washing chamber, wherein:

the prewashing station comprises a hose coupled to a prewashing nozzle; and washing the bag former at the prewashing station comprises spraying the bag former with the same or the different cleaning product from the prewashing nozzle.

17. The method of claim 11, further comprising:

moving the cart with the bag former to a drying station after removing the cart from the washing chamber; and drying the bag former at the drying station.

18. The method of claim 11, further comprising connecting one or more fluid lines to one or more corresponding gas channel fittings of the bag former when positioned in the washing chamber, wherein one end of the fluid lines is coupled to the corresponding gas channel fitting and an opposite end of the fluid lines is coupled to an adapter disposed in the washing chamber, and wherein the adapter includes one or more outlets to couple to the opposite end of the fluid lines.

19. The method of claim 18, further comprising washing one or more gas channels of the bag former by supplying the cleaning product through the adapter, the one or more fluid lines, and the one or more corresponding gas channel fittings.

20. The method of claim 19, wherein the adapter includes at least two, different sized outlets for connection to the fluid lines, for connecting to different sized gas channel fittings.

* * * * *